United States Patent [19]

Weinstein

[11] Patent Number: 4,602,486

[45] Date of Patent: Jul. 29, 1986

[54] COOLING METHOD AND APPARATUS

[76] Inventor: Norman Weinstein, 5640 Collins Ave., Miami Beach, Fla. 33140

[21] Appl. No.: 547,649

[22] Filed: Nov. 1, 1983

[51] Int. Cl.[4] ..... F25D 23/12

[52] U.S. Cl. ..... 62/261; 62/279; 5/421; 128/205.26

[58] Field of Search ..... 62/261, 279; 128/205.26, 205.1 B, 204.15; 5/421, 512, 508, 414

[56] References Cited

U.S. PATENT DOCUMENTS 2,134,003 10/1938 Morrison ..... 62/261
3,313,308 5/1967 Grosholz ..... 128/205.26
3,404,684 10/1968 Brewer ..... 128/205.26
3,476,256 11/1969 Anderson ..... 5/512

FOREIGN PATENT DOCUMENTS 55334 4/1982 Japan ..... 62/279

*Primary Examiner*—Henry Bennett
*Attorney, Agent, or Firm*—Dressler, Goldsmith, Shore, Sutker & Milnamow, Ltd.

[57] ABSTRACT

A method and apparatus are provided for cooling a selected region. A portable enclosure is provided for encompassing the region and defining an opening at the upper part of the region. A portable heat exchanger is provided at an elevation adjacent the opening over the region. Coolant is circulated through the heat exchanger whereby ambient air is cooled by the heat exchanger and flows downwardly into the region.

6 Claims, 19 Drawing Figures

FIG. 11
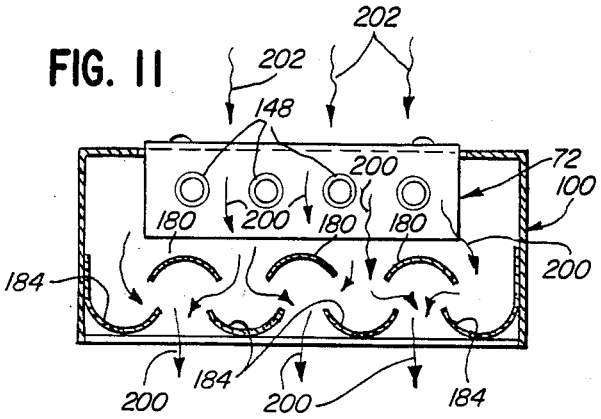
FIG. 12
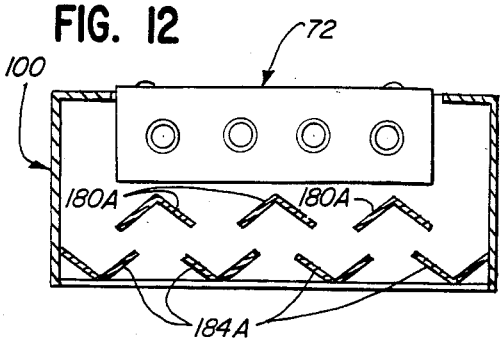
FIG. 13
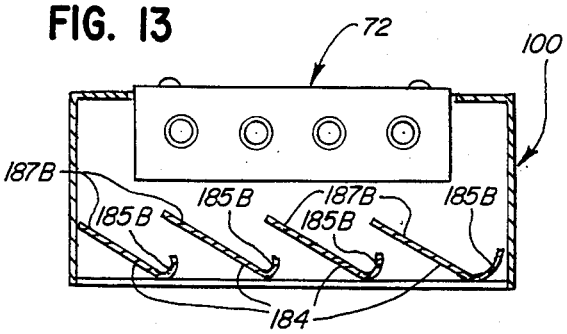
FIG. 14
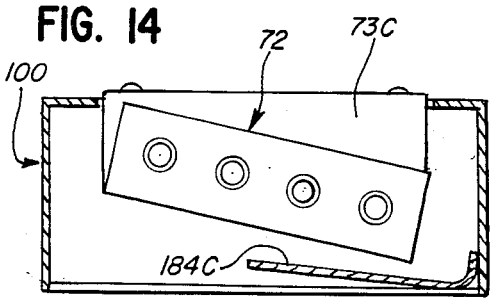
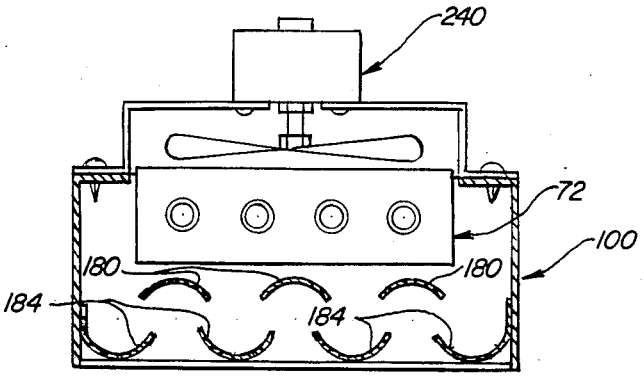
FIG. 15

FIG. 16
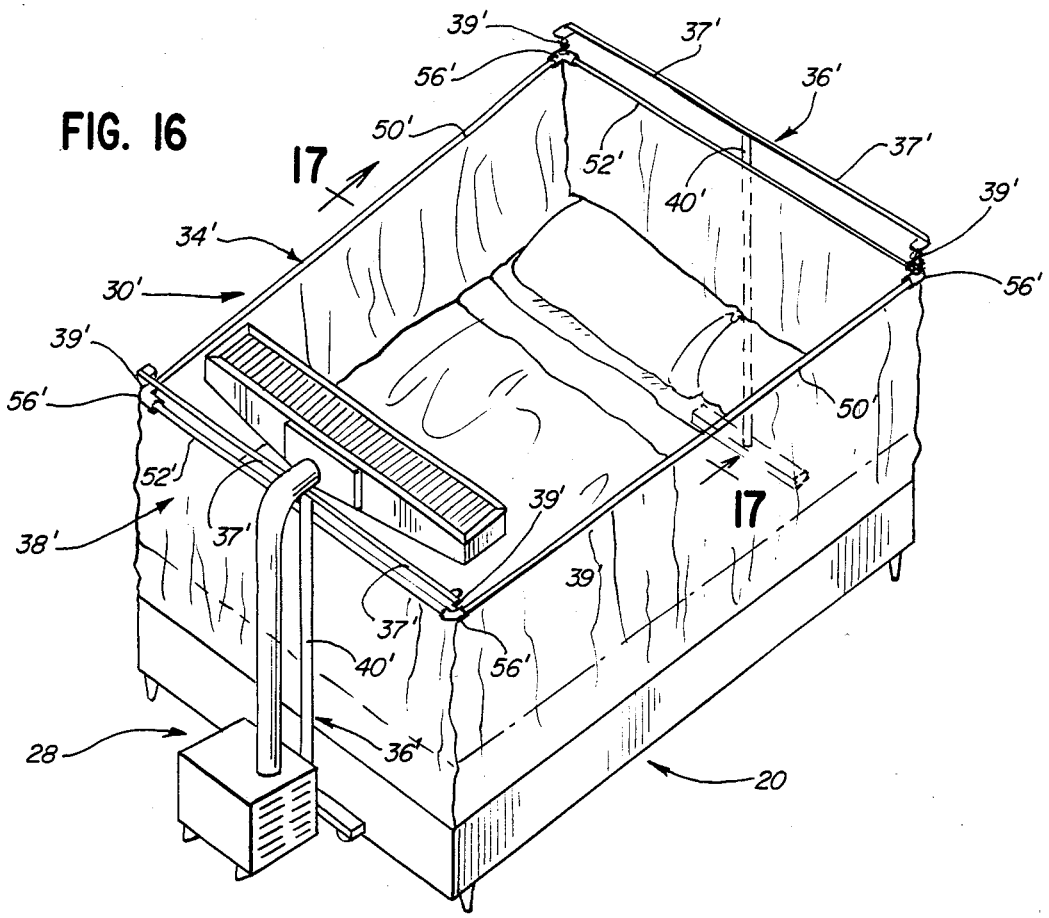
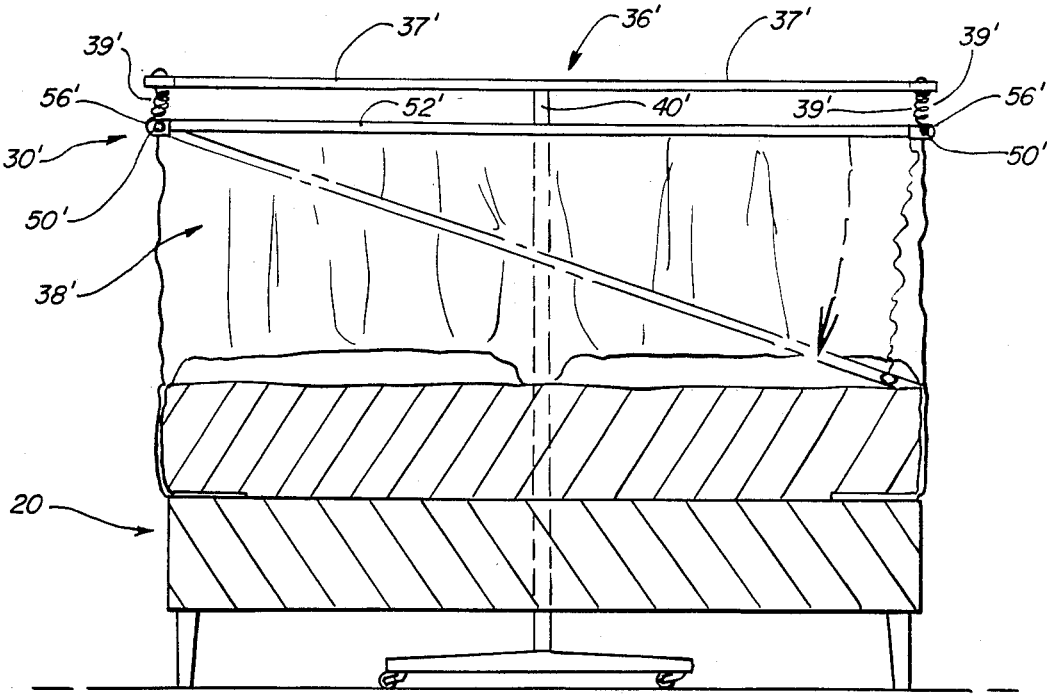
FIG. 17

COOLING METHOD AND APPARATUS

TECHNICAL FIELD

This invention relates to a method and apparatus for cooling a selected region by effecting the cooling of air or other gas and introducing the cool air or other gas into the region.

BACKGROUND OF THE INVENTION AND TECHNICAL PROBLEMS POSED BY THE PRIOR ART

Air conditioning methods and apparatus for cooling an entire building, home, or other structure are well known. Also, portable air conditoners, which can be mounted in a window or sleeve through a wall, are commonly used in many parts of the world to cool a single room. Such portable air conditioners, if large enough, may also be used to cool a number of rooms.

Such conventional air conditioning methods and apparatus necessarily cool an entire volume defined within the confines of the room or building that is being cooled. Thus, even regions in the room or building that are not normally occupied by people are cooled. For example, inaccessible regions beneath and behind furniture or near the ceiling are cooled when the room is cooled. The inventor of the present invention has discovered that, from the standpoint of human environmental comfort (the basic objective of these conventional types of air conditioning systems), the cooling of such regions is wasteful and unnecessary.

Over the last decade, energy costs have risen dramatically in the United States of America and in many other countries around the world. As a result, the operation of such conventional air conditioning systems has become relatively much more expensive than it was a decade ago. For example, in many parts of the United States of America, it is not uncommon for the operation of an electric air conditioning system in a small three room apartment to double or triple the monthly electric power utility bill for that apartment in the hot summer months.

The inventor of the present invention has recognized the above-described disadvantages with conventional air conditioning systems. The inventor has discovered that operating costs can be reduced if the cooling of unoccupied portions of a room is eliminated.

It would be advantageous to provide a method and apparatus for cooling a local environment or selected region within a room in such a manner as to reduce the operating cost to only a small fraction of the operating cost for conventional air conditioning systems. Further, it would beneficial if such an improved method could be effected with a relatively small, portable apparatus that (1) could be used in a variety of locations and (2) could be readily transported and set up at a selected location. Also, it would advantageous if such an apparatus was relatively inexpensive, easy to operate, compact, generally service-free, and operable on common household electric current (e.g., 15 amperes at 115 volts alternating current that is common throughout the United States of America).

SUMMARY OF THE INVENTION

A method and appartus are provided for cooling a selected region. A portable enclosure is provided for encompassing the region and defining an opening at the upper part of the region. A portable heat exchanger is provided at an elevation adjacent the opening over the region and coolant is circulated through the heat exchanger whereby ambient air is cooled by the heat exchanger and flows downwardly into the region.

For effecting this method, the apparatus includes, in addition to the enclosure and heat exchanger, suitable means, such as a pump or compressor, for circulating the coolant through the heat exchanger.

The apparatus also includes a movable support structure for being positioned on the floor adjacent the region to be cooled. The movable support structure has an upper end for being positioned adjacent the opening defined by the enclosure. The heat exchanger is mounted to the upper end of the support structure. By proper placement of the movable support structure, the heat exchanger can be positioned at an elevation adjacent the enclosure opening over a portion of the region to be cooled.

In a preferred embodiment, the apparatus is specifically adapted for cooling a region of an article of furniture wherein the region is intended to be partially occupied by part or all of a person. The apparatus enclosure includes (1) a frame for extending around the periphery of the article of furniture, (2) a frame support means for supporting the frame on the floor at a predetermined elevation relative to the region to be cooled, and (3) flexible sheet material hanging from the frame for encompassing the region to be cooled.

In the preferred embodiment, the heat exhanger is preferably an evaporator coil for use with a refrigerant fluid, and the means for circulating the coolant includes a compressor. Preferably, the apparatus also includes a drain means for collecting condensate from the exterior surfaces of the evaporator coil and for discharging the collected condensate exterior of the enclosure.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 11 is a cross-sectional view taken generally along the planes 11—11 in FIG. 4;

FIGS. 12–15 are each a view similar to FIG. 11 but showing an alternate embodiment of the evaporator coil and drain means;

FIG. 16 is a perspective view similar to FIG. 1 but showing an alternate embodiment of the enclosure of the apparatus of the present invention;

FIG. 17 is a cross-sectional view taken generally along the plane 17—17 in FIG. 16;

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments illustrated, and the scope of the invention will be pointed out in the appended claims.

The precise shapes and sizes of the components herein described are not essential to the invention unless otherwise indicated.

For ease of description, the apparatus of this invention is described in the normal operating position and terms such as upper, lower, horizontal, etc., are used with reference to this position. It will be understood, however, that the apparatus of this invention may be manufactured, stored, transported, and sold in an orientation other than the position described.

Some of the figures illustrating the preferred embodiments of the apparatus of this invention show conventional structural details and conventional mechanical elements that will be recognized by one skilled in the art. However, detailed descriptions of such conventional elements are not necessary to an understanding of the invention, and accordingly, are not herein presented.

Figure 1:
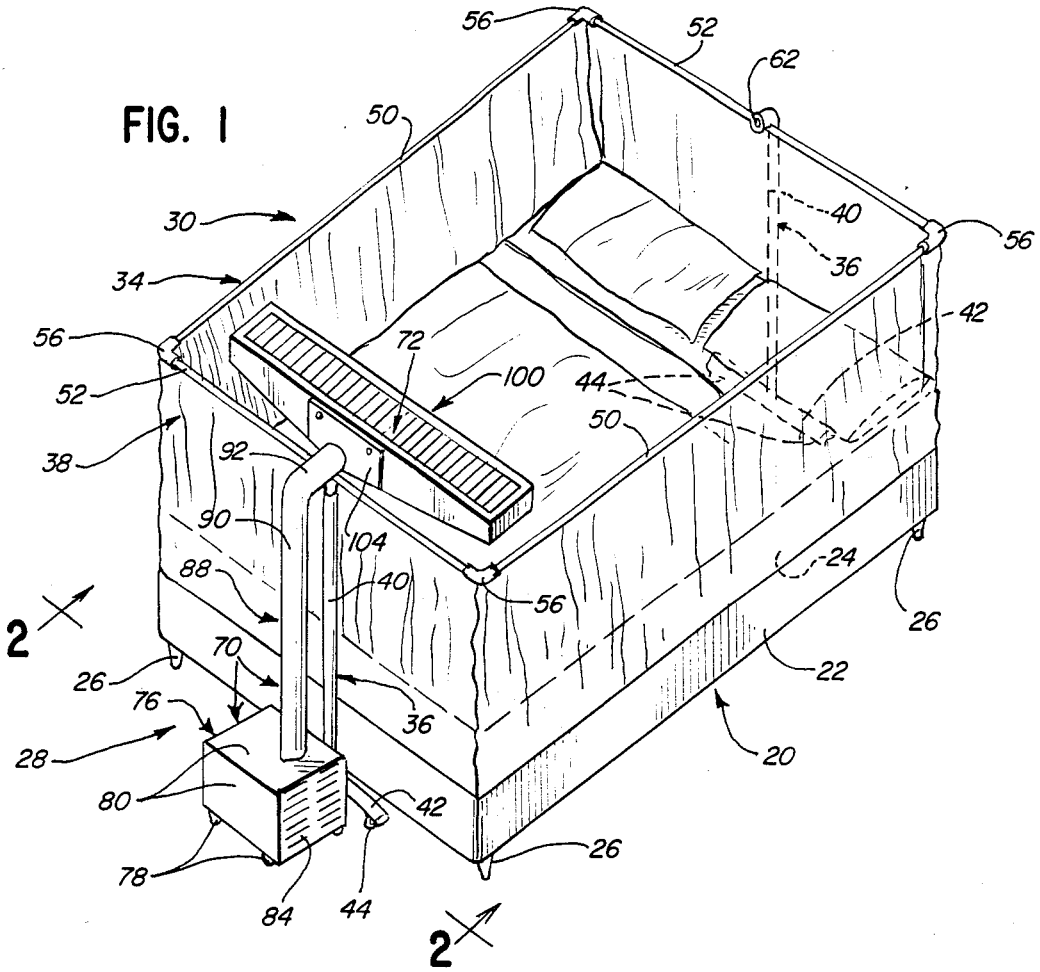
FIG. 1 is a perspective view showing one embodiment of the apparatus of the present invention in use for cooling a region above the reposing surface of a bed.

FIG. 1 illustrates a first embodiment of the apparatus as it is specifically adapted for cooling a selected region adjacent an article of furniture. The article of furniture is a bed 20 having a conventional box spring 22 on which is disposed a mattress 24. The bed 20 is supported above the floor by legs 26 which are part of a conventional frame (not visible in the figures).

The apparatus includes a portable enclosure 30 for encompassing a region to be cooled by a portable cooling assembly 28 and for defining an opening at the upper part of the region. In this embodiment, the region to be cooled is that volume above the reposing surface of the bed 20. During normal use of the bed 20, the region above the bed reposing surface is, of course, at least partially occupied by one or more persons lying on the bed in the usual resting or sleeping positions.

In this embodiment of the apparatus, it is contemplated that the enclosure 30 extends to a height of about 18 inches above the reposing surface of the bed 20. The enclosure 30 defines a region to be cooled that has a generally right rectangular prism shape coextensive with the reposing surface of the bed and extending upwardly about 18 inches.

The portable enclosure 30 includes (1) a frame 34 for extending around the periphery of the bed 20, (2) a frame support means 36 for supporting the frame 34 on the floor at a predetermined elevation above the bed reposing surface, and (3) flexible sheet material 38 hanging from the frame 34 for encompassing the region to be cooled at the periphery of the bed and for defining an opening at the upper part of the region above the bed reposing surface. Preferably, the lower margin of the flexible sheet material 38 is disposed between the mattress 24 and the box spring 22 to effect somewhat of a seal around the periphery of the bed 20. This prevents flow of cool air out of the region defined over the bed 20 by the enclosure 30 and prevents lateral flow of warmer air into the region from the ambient atmosphere exterior of the enclosure 30.

Figure 2:
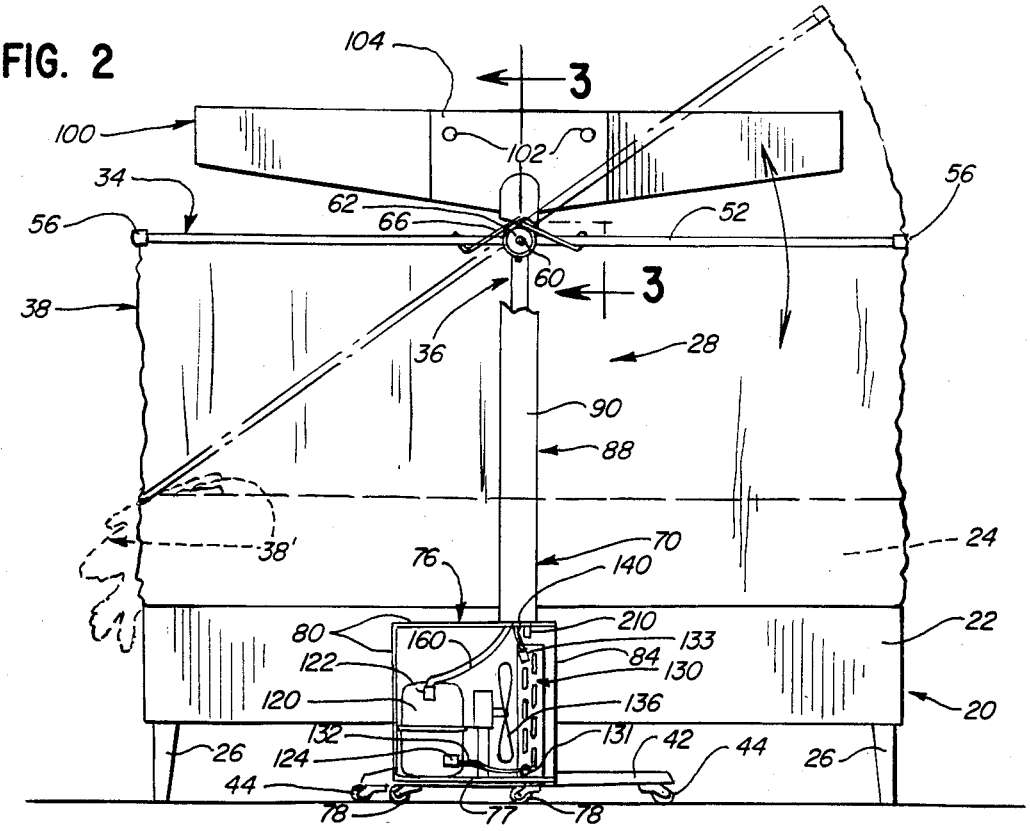
FIG. 2 is an enlarged end view of the apparatus taken generally along the plane 2—2 in FIG. 1 with portions of the apparatus broken away to illustrate interior detail.

As illustrated for the first embodiment in FIGS. 1 and 2, the frame support means 36 includes two spaced-apart support columns 40 with one of the columns 40 positioned at the head of the bed 20 and with the other of the columns 40 positioned at the foot of the bed 20. Each column 40 has a generally horizontal base section 42 with wheels or casters 44. The support columns 40 function to support the frame 34 in a predetermined position by novel means described in detail hereinafter.

In the first embodiment illustrated in FIGS. 1 and 2, the frame 34 includes two spaced-apart parallel side members 50 and two spaced-apart parallel end members 52 which are joined in a generally rectangular configuration by suitable corner connectors 56. In the embodiment illustrated, the side members 50 and end members 52 are each generally cylindrical, and each connecting member 56 is a 90° elbow fitting adapted to receive an end of a side member 50 and an end of an end member 52.

Preferably, the frame 34 is manufactured and sold in a knocked down condition to facilitate packaging and transport. Preferably, the members 50 and 52 are adapted to be simply slipped into place in the connecting members 56. To prevent inadvertent pull-out, conventional mechanical interlocks may be employed, such as finger operated locking screws, snap-fit engagements, and the like. Preferably, the frame 34 is easily disassembled to facilitate the storage of the entire apparatus, such as during seasons of the year wherein cooling of the bed region is not desired.

In any case, the frame 34 is preferably designed to lie substantially in a plane above the floor while supported by the support columns 40. To this end, as best illustrated in FIGS. 2 and 3, each support column 40 includes a generally cylindrical member 60 at the top of the column with an outwardly projecting pin 62 for being received in a suitable mating aperture in the adjacent end member 52 of the frame 34.

Figure 3:
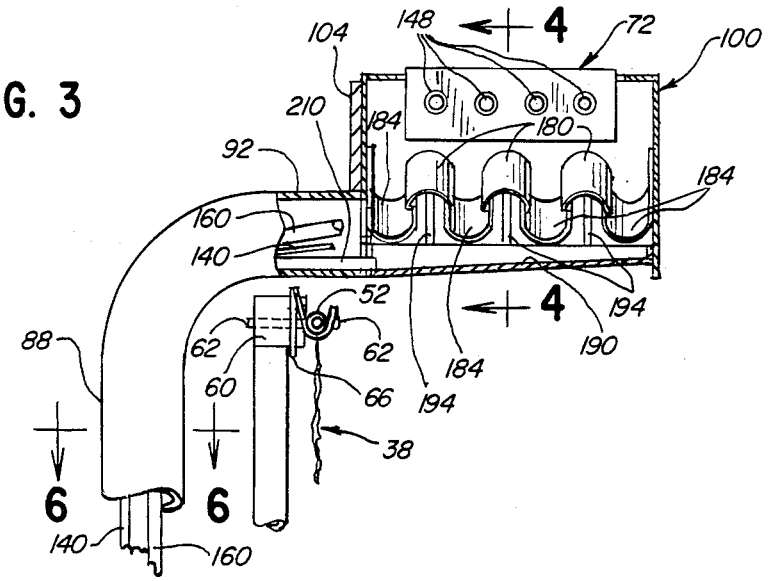
FIG. 3 is an enlarged, fragmentary, cross-sectional view taken generally along the planes 3—3 in FIG. 2.

A torsion spring 66 is disposed around the cylindrical member 60, and the two ends the spring 66 cradle the frame end member 52 on either side of the pin 62 (FIG. 3). The springs 66 bias the frame 34 to a normal position generally parallel with the floor but permit pivoting of the frame 34 from the normal position to facilitate ingress and egress as illustrated in dashed lines in FIG. 2.

As illustrated in FIG. 2, the frame may be pivotted downwardly on one side so that one of the frame side members 50 is substantially adjacent the reposing surface of the bed 20. As this occurs, the portion of the flexible sheet material 38 on the lower side of the frame 34 is carried downwardly and part of it may lie on the reposing surface of the bed 20 adjacent the edge of the bed, and part of the sheet material 38 may hang outwardly alongside the mattress 24 as indicated in FIG. 2 in dashed lines by reference numeral 38'.

When the frame 34 is pivoted to the position illustrated in dashed lines in FIG. 2, the raised portion of the frame 34 will necessarily carry part of the sheet material 38 upwardly. To this end, the sheet material 38 must be arranged to permit such upward movement. One solution is to provide some slack in the hanging sheet material 38 to permit the pivoting of the frame 34.

Of course, if the lower margins of the sheet material 38 are not disposed between the mattress 24 and box spring 22 and are, instead, permitted to hang down alongside the mattress and box spring, then there will be no need to provide slack in the sheet material 38.

The flexible sheet material 38 may be fabricated from cloth or other suitable flexible material. Thermoplastic sheet or film materials may be employe. Some or all portions of the sheet material 38 may desirably be transparent. Also, the sheet material 38 may include a plurality of individual sheets, such as a sheet on each of the four sides of the enclosure 30. Individual sheets may be zipped, buttoned, or otherwise suitably fastened together along the adjacent vertical margins if desired.

Preferably, the flexible sheet material 38 is hung from the frame 34 by suitable conventional means, such as with hooks or rings (not illustrated) that are fabricated from solid or flexible materials and that encircle the frame members 50 and 52 while also engaging the top margins of the flexible sheet material 38. Such hooks or rings may be of any suitable conventional design, and the details of such a design form no part of the present invention. The hooks or rings have been ommitted from the figures for ease of illustration.

If desired, a portion or all of the flexible sheet material 38 may be replaced with a substantially rigid member or members. However, lightweight flexible sheet material 38 would appear to be preferable in most situations from the standpoint of facilitating storage, minimizing the apparatus cost, and minimizing the apparatus weight.

As best illustrated in FIGS. 1 and 2, the portable cooling assembly 28 includes a movable support structure 70 for being positioned on the floor adjacent the region to be cooled and has an upper end for being positioned adjacent the opening at the upper part of the region encompassed by the enclosure 30. A heat exchanger 72 is mounted to the upper end of the movable support structure 70 for being positioned at an elevation adjacent the opening.

The portable cooling assembly 28 also includes means for circulating coolant through the heat exchanger 72 in a manner described in detail hereinafter. Ambient air is cooled by the heat exchanger 72 and flows downwardly into the region within the enclosure 30. Warmer air in the region is displaced by the incoming cooler air and flows upwardly out of the enclosure 30 through the remaining portion of the enclosure opening.

The movable support structure 70 includes, as best illustrated in FIG. 2, a mobile base 76 having a base plate 77 and an enclosure 80. In the embodiment illustrated, the enclosure 80 has the configuration of a hollow cube with one of the faces of the cube being defined by a grill 84 to accommodate the venting of warm air from the interior of the enclosure to the ambient atmosphere. Preferably, the mobile base 76 is provided with casters or wheels 78 to facilitate movement of the movable support structure 28 to the desired location.

With reference to FIGS. 1–3, the movable support structure 70 also includes a supporting shroud 88 (FIGS. 1–3) which has (1) a generally vertical portion 90 (FIG. 1 and 2) mounted to and extending upwardly from the mobile base 76 and (2) a transverse portion 92 (FIG. 1 and 3) extending laterally from the vertical portion 90 and defining the upper end of the movable support structure 28 to which the heat exchanger 72 is mounted. In the preferred embodiment illustrated, the supporting shroud 88 is a closed, hollow tube.

As best illustrated in FIGS. 1, 3–5, 10, and 11, the heat exchanger 72 is a direct expansion cooling coil or evaporator coil for use with a refrigerant fluid. Such a coil may be of a suitable conventional design. Such coils, in a variety of sizes, are manufactured by, among others, Carrier Corporation, Carrier Parkway, Syracuse, N.Y. 13221 U.S.A.; York Division, Borg-Warner Corporation, South Richland Avenue, York, Pa. 17405 U.S.A.; and Trane Company, 3600 Thomas Creek Road, La Crosse, Wis. 54601 U.S.A.

Figure 10:
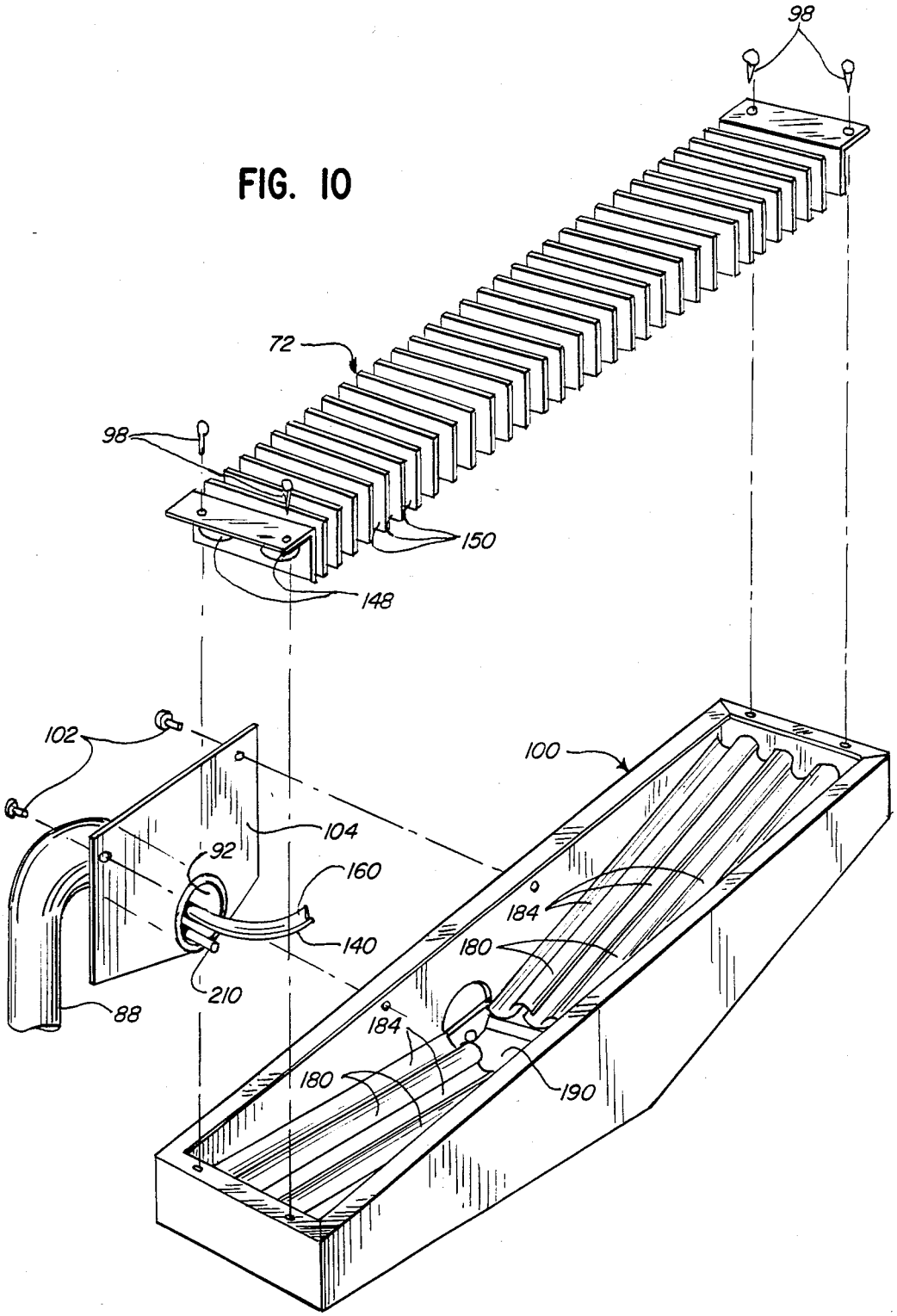
FIG. 10 is an exploded, perspective view of the upper end of the movable support structure, evaporator coil, and drain means.

As best illustrated in FIG. 10, the evaporator coil 72 is mounted with screws 98 to a housing 100. The housing 100 is secured with screws 102 to a support plate 104 which is fixed to the end of the transverse portion 92 of the supporting shroud 88. Alternatively, the housing 100 and plate 104 may be molded as a unitary structure from suitable thermoplastic materials.

FIG. 2 illustrates a preferred embodiment of the means for circulating coolant through the heat exchanger 72. The preferred form illustrated in the cooling assembly 28 is adapted for circulating a refrigerant fluid through a heat exchanger 72 that is a direct expansion cooling coil or evaporator coil of the type described above.

Specifically, the portable cooling assembly 28 includes, on the mobile base 76 within the enclosure 80, a compressor 120 with a suction inlet 122 and a discharge outlet 124 along with a suitable means (not illustrated) for operating the compressor 120 to compress and circulate the refrigerant fluid. Such a coventional compressor operating means may include a suitable conventional electric motor. For the embodiment of the portable cooling apparatus illustrated in FIGS. 1 and 2 which is specifically adapted for cooling a region above a bed, it is contemplated that a conventional electric motor of about one-tenth or one-eighth horsepower could be used. However, smaller or larger motors may be used where the specific cooling demands are lesser or greater, respectively.

The compressor may be of a suitable conventional design. Conventional small compressors or conventional small condensing units (which include a compressor, compressor motor, condensing coil, cooling fan, and fan motor in one sub-assembly) are manufactured by, among others, Tecumseh Products Company, Tecumseh, Mich. 49286 U.S.A.; Copeland Corporation, Campbell Ro, Sidney, Ohio 45365 U.S.A.; and Danfoss, Inc., 16-T McKee Drive, Mahwah, N.J. 07430 U.S.A. The specific design of such conventional compressors or condensing units forms no part of the present invention.

A condensing coil 130 is located on the mobile base 76 and is connected with the compressor discharge outlet 124 by means of conduit 132. The condensing coil 130 may be of a suitable conventional finned tube type that is free standing, that is spaced from the compressor 120, and that has an inlet 131 and an outlet 133. If desired, a conventional electrically operated fan 136 may be provided for effecting forced air cooling of the condensing coil 130. Alternatively, the condensing coil 130 may be of a suitable conventional finned tube type that is woud around the body of the compressor 120.

Figure 5:
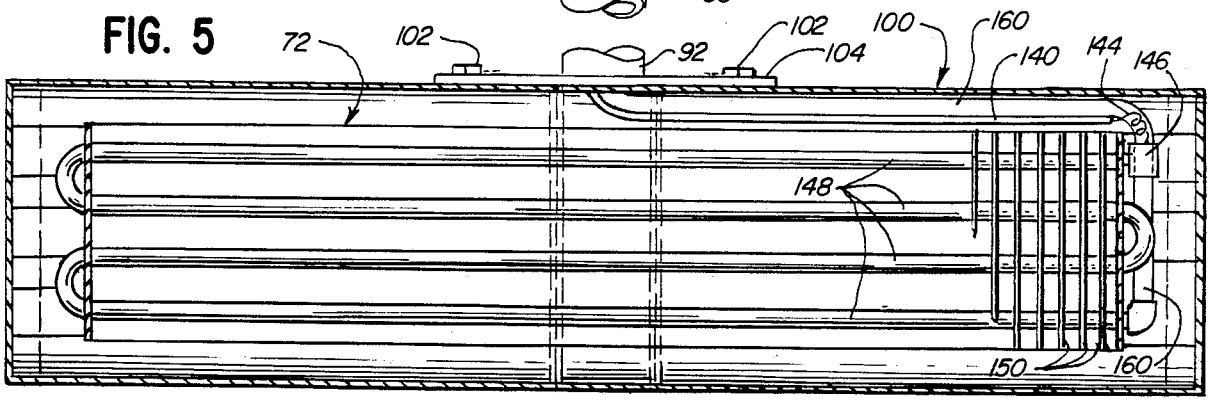
FIG. 5 is a fragmentary, cross-sectional view taken generally along the plane 5—5 in FIG. 4.

In any case, a liquid conduit 140 is provided for carrying the refrigerant fluid in the liquid phase and connecting the condensing coil 130 with the inlet of the evaporator coil 72. As best illustrated in FIG. 5, the liquid conduit 140 is routed through the supporting shroud 88 and along the inside of the housing 100 where the conduit 140 connects with capillary tubing 144 which is part of the inlet to the evaporator coil 72. The refrigerant liquid expands from the tubing 144 into a gas. The gas is directed through a suitable fitting 146 to the evaporator coil conduit 148. Heat is transferred from the cool refrigerant gas through the walls of the conduit 148 to fins 150 for cooling the ambient air adjacent the evaporator coil 72.

As best illustrated in FIGS. 2–6, a suction conduit 160 is provided and carrying the refrigerant fluid in the gas phase and for connecting the outlet of the evaporator coil 72 with the compressor suction inlet 122. As with the liquid conduit 140, the suction conduit 160 is routed through the supporting shroud 88 between the evaporator coil 72 and the enclosure 80 on the mobile support base 76.

When air is cooled by the evaporator coil 72, it will, owing to its slight density increase, flow downwardly from the evaporator coil 72 into the region that is to be cooled within the enclosure 30 above the bed 20. Depending upon the humidity of the air, condensate may form on the condensing coil 72. A novel drain means is provided for collecting the condensate from the exterior surfaces of the evaporator coil 72 and for discharging the condensate exterior of the enclosure 30.

Figure 4:
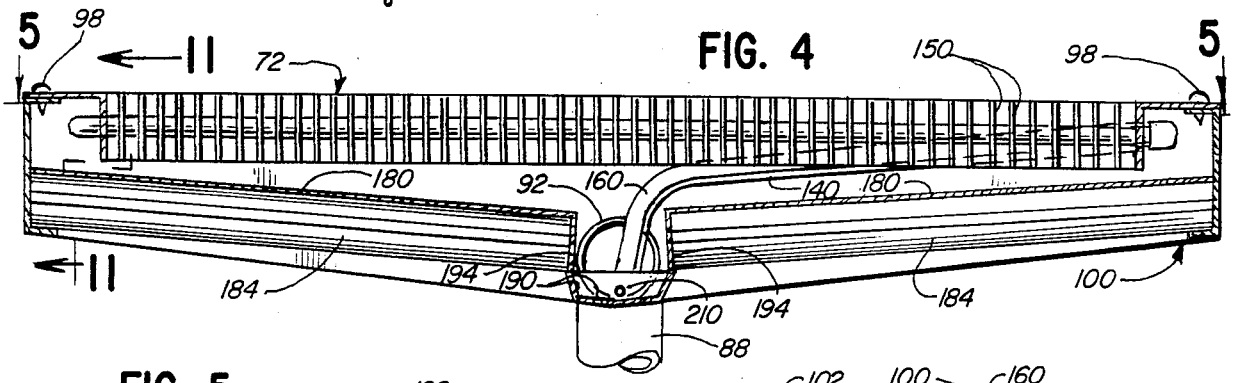
FIG. 4 is a fragmentary, cross-sectional view taken generally along the plane 4—4 in FIG. 3.

Specifically, as best illustrated in FIGS. 3–5, 10, and 11, the drain means includes a plurality of spaced-apart baffles 180 which are disposed below the evaporator coil 72 and which slant (as best illustrated in FIG. 4) downwardly from each end of the housing 100 toward the middle of the housing. The baffles 180 divert some of the condensate dripping from the evaporator coil. The diverted condensate flows to the edges of the baffles 180 and then drips downwardly off of the baffles.

A plurality of spaced-apart, inclined, drain trays 184 are arranged below the baffles 180 to receive the diverted condensate dripping from the edges of the baffles 180 and to receive condensate dripping directly from the evaporator coil 72. The drain trays 184 are inclined in the same manner as the baffles 180 and will therefore discharge the collected condensate into a central region of the housing 100 below the evaporator coil 72.

A central drain pan 190 is mounted to the housing 100 below the lower ends of the drain trays 184. The drain pan 190 collects the condensate flowing off of the lower ends of the drain trays 184.

The lower ends of the drain trays 184 may be supported directly on the drain tray 190 as best illustrated in FIGS. 3 and 4. The lower ends of the baffles 180 are also supported from the drain tray 190 by means of small rods 194 as best illustrated in FIGS. 3 and 4. The upper ends of the baffles 180 and drain trays 184 are suitably moted or secured, as by welding, to the end walls of the enclosure 100.

If desired the entire subassembly of the baffles 180, drain trays 184, and the central drain pan 190 may be fabricated from a thermoplastic material with appropriate supporting and spacer structures to maintain the baffles, drain trays, and central drain pan in the desired configuration.

As best illustrated in FIG. 11, the ambient air cooled by the evaporator coil 72 flows downwardly, as indicated by arrows 200, past the evaporator conduit 148 and through the enclosure 100. The cool air flows around the baffles 180 and drain trays 184 and then out of the housing 100 into the region to be cooled. Uncooled ambient air flows (as indicated by arrows 202) adjacent the evaporator coil 72 as the cooled air 200 flows downwardly away from the evaporator coil 72.

As best illustrated in FIGS. 2, 3, 4, 6 and 10, a drain conduit 210 communicates with the central drain pan 190 and extends through the supporting shroud 88 to the enclosure 80 on the mobile base 76. Preferably, the end of the conduit 210 in the enclosure 80 is positioned to discharge the condensate over the condensing coil 130. The condensate dripping on the condensing coil 130 will be evaporated by the heat of the condensing coil 130.

Figure 6:
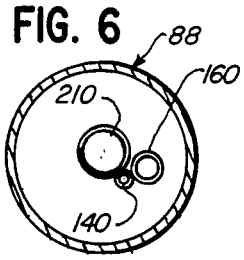
FIG. 6 is a cross-sectional view taken generally along plane 6—6 in FIG. 3.

As best illustrated in FIG. 6, the liquid conduit 140, suction conduit 160, and drain conduit 210 are preferably arranged in relatively close relationship within the supporting shroud 88. Preferably, the liquid conduit 140 is arranged to be in contact with the suction conduit 160 and with the drain conduit 210. Heat from the liquid conduit 140 will help re-evaporate moisture in the drain conduit 210. The transfer of heat from the liquid conduit 140 to the drain conduit 210 will help to further precool the refrigerant liquid within the liquid conduit 140. This will reduce the energy required by the compressor 120.

Figure 7:
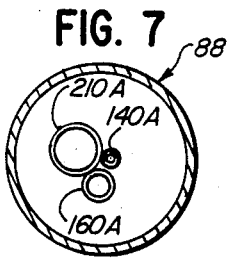
FIGS. 7–9 are each a cross-sectional view similar to FIG. 6 but showing alternate embodiments.
Figure 8:
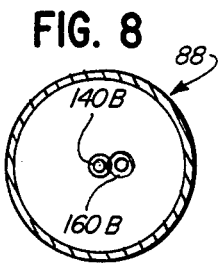
Figure 9:
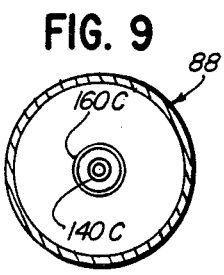

FIG. 7–9 illustrate alternate embodiments of the arrangement of the suction, liquid, and drain conduits within a supporting shroud. In the embodiment illustrated FIG. 7, the liquid conduit 140A is in contact with the drain conduit 210A but is spaced away from the suction conduit 160A. However, the suction conduit 160A is in contact with the drain conduit 210A.

In the embodiment illustrated in FIG. 8, the entire supporting shroud 88 functions as the drain conduit between the drain pan 190 and the enclosure 80 on the mobile base 76. The liquid conduit 140B and the suction conduit 160B are in contact within the supporting shroud.

In the embodiment illustrated in FIG. 9, the supporting shroud 88 also functions as the drain conduit. However, within the shroud 88, the suction conduit 160C surrounds the liquid conduit 140C. The refrigerant gas is carried in the annular space between the exterior of the liquid conduit 140C and the interior of the suction conduit 160C.

FIGS. 12–14 illustrate alternate embodiments of the structure or means for the collecting condensate from the exterior surfaces of the evaporator coil 72. In the embodiment illustrated in FIG. 12, the evaporator coil 72 and housing 100 are assembled in a manner similar to that in the first embodiment illustrated in FIGS. 3–5, 10 and 11. However, in the embodiment illustrated in FIG. 12 the baffles 180A each have an inverted V-shaped cross-section rather than an arcuate cross-section. Also, the drain trays 184A have a V-shaped cross-section rather than an arcuate cross-section The baffles 180A and the drain trays 184A are each inclined downwardly to a central drain pan (not visible in FIG. 12) below the evaporator coil 72 in the same manner as the baffles 180 and drain trays 184 in the embodiment illustrated in FIGS. 3–5, 10 and 11.

In the embodiment illustrated in FIG. 13, the enclosure 100 and evaporator coil 72 are also assembled in a manner similar to that of the first embodiment iustrated in FIGS. 3–5, 10 and 11. However, in the embodiment illustrated in FIG. 13, the baffles are omitted, and the drain trays 184B each include a lip portion 185B and an angled portion 187B. The angled portion 187B of one drain tray 184B extends over the lip portion 185B of an adjacent drain tray 184B. Condensate dripping from the evaporator coil 72 will impinge upon the angled portions 187B of the drain trays 184B and will thus be prevented from dripping out of the housing 100. Each drain tray 184B is inclined to drain the condensate to a central drain pan (not visible in FIG. 13) in the same manner as the drain trays 184 in the embodiment illustrated in FIGS. 3–5, 10 and, 11.

In the embodiment illustrated in FIG. 14 a housing 100 is provided with substantially the same configuration as the housing 100 of the embodiment illustrated in FIGS. 3–5, 10 and 11. However, the evaporator coil 72 is oriented at an angle by means of end brackets 73C. Condensate will tend to flow along the surfaces of the angled evaporator coil 72 and drip off of the lowermost edges. Below the lowermost edges of the evaporator coil 72 there are two drain trays 184C (only one being visible in FIG. 14). The trays 184C are sloped downwardly to a central drain pan (not visible in FIG. 14) for discharging condensate in a manner similar to the individual drain trays 184 illustrated in FIGS. 3–5, 10 and 11.

In some applications, it may be desirable to force ambient atmosphere air through the heat exchanger or evaporator coil 72. A means for effecting such forced air flow in an alternate embodiment is illustrated in FIG. 15. Specifically, the heat exchanger 72 is mounted within the housing 100 in a manner substantially identical to that described above for the first embodiment illustrated in FIGS. 3–5, 10 and 11. However, one or more electrically operated fans 240 are mounted above the heat exchanger 72 on the housing 100. Operation of the fans 240 forces the air downwardly through the heat exchanger 72 and into the region to be cooled.

FIGS. 16 and 17 illustrate an alternate form of the enclosure 30′ which is specifically adapted for use with the portable cooling assembly 28 to cool a region above the reposing surface of a bed 20. The enclosure 30′ includes a suitable flexible sheet material 38′ hanging from a frame 34′ in the same manner as the sheet material 38 described above with reference to the first embodiment illustrated in FIGS. 1 and 2. The frame 34′ may comprise parallel side members 50′ and parallel end members 52′ joined at their ends with suitable elbow fittings 56′ to form a generally rectangular configuration.

The frame 34′ is maintained at the desired orientation relative to the bed 20 by means of a frame support means 36′ which includes two spaced-apart support columns 40′. Each support column 36′ includes a pair of oppositely extending, generally horizontal arms 37′.

The enclosure 30′ further includes a spring 39′ disposed at the distal end of each arm 37′. Each spring 39′ is connected between the frame 34′ and the arm 37′ to hold the frame 34′ in a predetermined position relative to the region to be cooled within the enclosure 30′. The springs 39′ permit movement of at least a portion of the frame 34′ from the predetermined position illustrated in FIG. 16 to another position, such as that illustrated in in dashed lines in FIG. 17, for facilitating ingress and egress.

Figure 18:
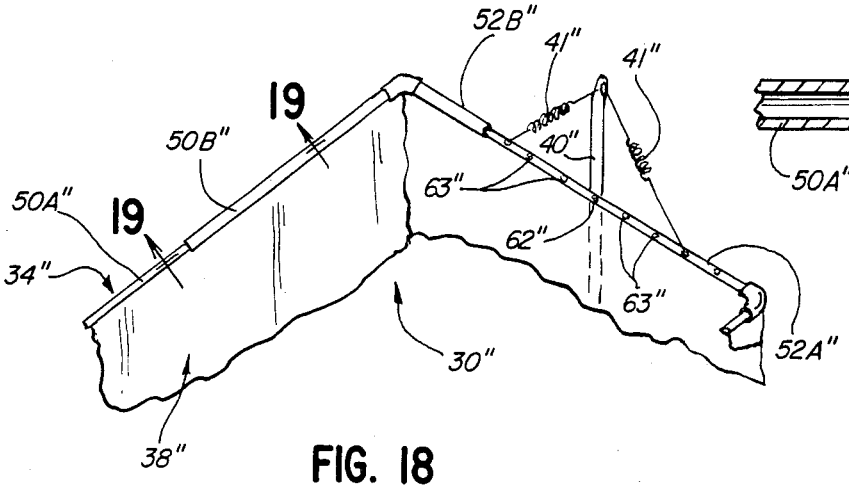
FIG. 18 is a fragmentary, perspective view of a portion of still another embodiment of the enclosure of the appartus of the present invention.
Figure 19:
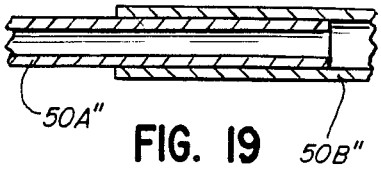
FIG. 19 is a greatly enlarged, fragmentary, cross-sectional view taken along the plane 19—19 in FIG. 18.

FIGS. 18 and 19 illustrate still another embodiment of an enclosure 30″ for use with the portable cooling assembly 28. On each side of the frame 34″ there are two side rods 50A″ and 50B″ which together form a single side member of the frame. The rods 50A″ and 50B″ are telescopically disposed for facilitating length adjustment of the rectangular frame.

On each end of the frame 34″ there are two end rods 52A″ and 52B″ which are telecopically disposed in a manner identical to that for the side rods 50A″ and 50B″ described above. This end rod structure permits adjustment of the width of the frame 34″.

If desired, the telescoping arrangement of the frame members described above with reference to FIGS. 18 and 19 may be employed in the frame of the enclosure 30 illustrated in FIGS. 1 and 2 as well as in the frame of enclosure 30′ illustrated in FIG. 16 and 17.

FIG. 18 also illustrates still another way in which the frame 34″ may be positioned relative to the region to be cooled. Specifically, a portable support column 40″ is provided at each end of the frame 34″. The frame 34″ is pivotally mounted at each end to one of the columns 40″ by means of a pin 62″. A plurality of apertures 63″ are provided in each end rod 52A″ to accommodate the pin 62″ depending upon the adjusted width of the end rods 52A″ and 52B″.

The enclosure 30″ further includes a pair of springs 41″ at each end of the enclosure 30″. The springs 41″ are each attached on one end to the top of the support column 40″ and are attached at the other end to the end rod 52A″ through one of the apertures 63″. This structure permits the frame 34″ to be pivoted to one side or the other to facilitate ingress and egress.

Use of a portable apparatus for cooling a region in accordance with the teachings of the present invention can offer considerable savings compared with using conventional air conditioning systems to cool an entire room or building in which the region is located.

When the portable apparatus described herein is employed to cool the region above the reposing surface of a bed, the power requirements for the apparatus will be relatively low. It is believed that an amount of cooling adequate for human sleeping comfort in many areas of the world can be effected with the portable apparatus described herein at the relatively low energy cost equivalent to that which would result from operating a 100 or 200 watt light bulb over the same period of time that the portable cooling apparatus is operated.

Although the preferred embodiments of the portable cooling apparatus have been described as adapted or employed for cooling a region associated with a bed, it is to be realized that the method and apparatus of the present invention may be employed to cool a region associated with other furniture articles or even a selected region that is not associated with an article of furniture.

It will be readily observed from the foregoing detailed description of the invention and from the illustrated embodiments thereof that numerous variations and modifications may be effected without departing from the true spirit and scope of the novel concepts or principles of this invention.

What is claimed is:

1. A portable apparatus for cooling a selected region, said apparatus comprising:

a portable enclosure for encompassing said region and defining an opening at the upper part of said region, said enclosure comprising:

a frame for extending around the periphery of said region;

a frame support means for supporting said frame at a predetermined elevation relative to said region; and flexible sheet material hanging from said frame for encompassing said region and for defining an opening at the upper part of said region;

said frame being pivotally mounted to said frame support means; and said enclosure further including a torsion spring on said frame support means, said spring being engaged with said frame for biasing said frame to a normal position generally parallel with the floor but permitting pivoting of said frame from the normal position to facilitate ingress and egress; and a portable cooling assembly including (1) a movable support structure for being positioned on the floor adjacent said region and having an upper end for being positionhd adjacent said opening, (2) a heat exchanger mounted to said upper end of said support structure for being positioned at an elevation adjacent said opening over a portion of said region, and (3) means for circulating coolant through said heat exchanger whereby ambient air is cooled by said heat exchanger and flows downwardly into said region.

2. A portable apparatus for cooling a selected region, said apparatus comprising:

a portable enclosure for encompassing said region and defining an opening at the upper part of said region, said enclosure comprising:

a frame for extending around the periphery of said region;

a frame support means for supporting said frame at a predetermined elevation relative to said region; and flexible sheet material hanging from said frame for encompassing said region and for defining an opening at the upper part of said region;

said frame support means including two spaced-apart support columns;

each said supoort column including a pair of oppositely extending, generally horizontal arms; and said enclosure further including a spring disposed at the distal end of each arm, each said spring being connected between said frame and said arm to hold said frame in a predetermined position relative to said region and to permit movement of at least a portion of said frame from said predetermined position for facilitating ingress and egress; and a portable cooling assembly including (1) a movable support structure for being positioned on the floor adjacent said region and having an upper end for being positioned adjacent said opening, (2) a heat exchanger mounted to said upper end of said support structure for being positioned at an elevation adjacent said opening over a portion of said region, and (3) means for circulating coolant through said heat exchanger whereby ambient air is cooled by said heat exchanger and flows downwardly into said region.

3. A portable apparatus for cooling a selected region, said apparatus comprising:

a portable enclosure for encompassing said region and defining an opening at the upper part of said region, said enclosure comprising:

a frame for extending around the periphery of said region;

a frame support means for supporting said frame at a predetermined elevation relative to said region; and flexible sheet material hanging from said frame for encompassing said region and for defining an opening at the upper part of said region;

said frame support means including columns with means for pivotally mounting said frame to said columns; and said enclosure further including a pair of springs which are each attached on one end to the top of one of said support columns and which are each attached at the other end to said frame; and a portable cooling assembly including (1) a movable support structure for being positioned on the floor adjacent said region and having an upper end for being positioned adjacent said opening, (2) a heat exchanger mounted to said upper end of said support structure for being positioned at an elevation adjacent said opening over a portion of said region, and (3) means for circulating coolant through said heat exchanger whereby ambient air is cooled by said heat exchanger and flows downwardly into said region.

4. A portable apparatus for cooling a selected region, said apparatus comprising:

a portable enclosure for encompassing said region and defining an opening at the upper part of said region; and a portable cooling assembly including:

(1) a movable support structure for being positioned on the floor adjacent said region and having an upper end for being positioned adjacent said opening, said movable support structure including a mobile base;

(2) a heat exchanger mounted to said upper end of said support structure for being positioned at an elevation adjacent said opening over a portion of said region;

(3) means for circulating coolant through said heat exchanger whereby ambient air is cooled by said heat exchanger and flows downwardly into said region;

(4) drain means associated with said heat exchanger for collecting condensate dripping from said heat exchanger, said drain means comprising:

a plurality of spaced-apart, upwardly convex, baffles disposed below said heat exchanger for diverting some of the condensate dripping from said heat exchanger;

a plurality of spaced-apart, inclined, upwardly concave, drain trays arranged below said baffles to receive the diverted condensate dripping from the edges of said baffles and to receive condensate dripping from said heat exchanger;

a central drain pan disposed below the lower ends of said drain trays for collecting condensate flowing off of the lower ends of said drain trays; and a drain conduit communicating with said central drain pan and extending exterior of said enclosure.

5. A portable apparatus for cooling a selected region, said apparatus comprising:

a portable enclosure for encompassing said region and defining an opening at the upper part of said region; and a portable cooling assembly including:

(1) a movable support structure for being positioned on the floor adjacent said region and having an upper end for being positioned adjacent said opening, said movable support structure including a mobile base;

(2) a heat exchanger mounted to said upper end of said support structure for being positioned at an elevation adjacent said opening over a portion of said region;

(3) means for circulating coolant through said heat exchanger whereby ambient air is cooled by said heat exchanger and flows downwardly into said region;

(4) drain means assoicated with said heat exchanger for collecting condensate dripping from said heat changer, said drain means comprising a plurality of spaced-apart, parallel, drain trays each arranged at an angle to said heat exchanger, at least some of said trays having an upturned lip disposed below an adjacent tray, and at least some of said trays being inclined, said drain means further comprising a drain pan disposed below the lower ends of said drain trays for collecting condensate flowing off of the lower ends of said drain trays; and (5) a drain conduit communicating with said drain pan and extending exterior of said enclosure.

6. A portable apparatus for cooling a selected region, said apparatus comprising:

a portable enclosure for encompassing said region and defining an opening at the upper part of said region; and a portable cooling assembly including:

(1) a movable support structure for being positioned on the floor adjacnet said region and having an upper end for being positioned adjacent said opening, said movable support structre including a mobile base;

(2) a heat exchanger mounted in an inclined orientation on said upper end of said support structure for being positioned at an elevation adjacent said opening over a portion of said region;

(3) means for circulating coolant through said heat exchanger whereby ambient air is cooled by said heat exchanger and flows downwardly into said region;

(4) drain means associated with said heat exchanger for collecting condensate dripping from said heat exchanger, said drain means comprising a drain pan disposed beneath part of said heat exchanger and comprising two horizontally spaced-apart, downwardly sloping, drain trays beneath said heat exchanger and above said drain pan; and (5) a drain conduit communicating with said drain pan and extending exterior of said enclosure.

* * * * *